US005100125A

United States Patent [19]

Uplinger et al.

[11] Patent Number: 5,100,125

[45] Date of Patent: Mar. 31, 1992

[54] APPARATUS FOR ADJUSTING ALIGNMENT OF ADVANCING SHEET MATERIAL

[75] Inventors: George Uplinger, Windsor, N.Y.; Walter Wolog, Orange, Conn.

[73] Assignee: Pitney Bowes Inc., Stamford, Conn.

[21] Appl. No.: 636,346

[22] Filed: Dec. 31, 1990

[51] Int. Cl.[5] ..... B65H 9/10

[52] U.S. Cl. ..... 271/233; 198/726; 271/271; 271/275; 271/198

[58] Field of Search ..... 271/198, 233, 269, 271, 271/226–228, 275; 198/726

[56] References Cited

U.S. PATENT DOCUMENTS

| | | | |
|---|---|---|---|
| 2,604,322 | 7/1952 | Babicz | 271/233 |
| 4,077,181 | 3/1978 | Asher et al. . | |
| 4,169,341 | 10/1979 | Roetter et al. . | |
| 4,546,597 | 10/1985 | Denker | 271/271 |

*Primary Examiner*—Joseph E. Valenza

*Assistant Examiner*—Steven M. Reiss

*Attorney, Agent, or Firm*—Charles R. Malandra, Jr.; David E. Pitchenik; Melvin J. Scolnick

[57] ABSTRACT

Apparatus is disclosed for aligning, i.e., de-skewing, sheet material having squared upstream and downstream edges which is being advanced along a path. The advancing apparatus includes a pair of endless belts having pushers projecting therefrom which engage the upstream edge of the sheet material to advance the sheet material with rotation of the belts. The disclosed apparatus adjusts the relative positions of the pushers so that the squared upstream and downstream edges of the sheet material are normal to the path of travel of the sheet material. The invention has particular application to mailing machines in which paper sheets to be inserted in envelopes are advanced towards a folding station and/or an envelope insertion station. The invention has particular application to use with apparatus that cross folds paper.

16 Claims, 2 Drawing Sheets

APPARATUS FOR ADJUSTING ALIGNMENT OF ADVANCING SHEET MATERIAL

BACKGROUND OF THE INVENTION

The invention disclosed herein relates to the adjustment of advancing sheet material relative to its path of advancement. More particularly, the invention relates to adjustment of paper being advanced in a mailing machine to a station which operates on the paper, for example folds the paper and/or inserts the paper into an envelope, so that the paper is presented to the station in a desired alignment. The invention has particular application for use with apparatus which cross folds paper.

The mailing process entails a number of operations including assembly and insertion of mail items into an envelope, sealing the envelope and applying postage. Frequently, mail items are sheets of paper which may have to be folded prior to insertion into an envelope depending on the paper and envelope sizes. In some applications, it is necessary to cross fold the paper, i.e., fold the paper once, rotate the once-folded paper 90°, advance the once-folded paper to be folded again (cross folded), and then cross fold the paper at a 90° angle to the first fold. Where the folding and/or insertion portions of the mailing process are automated, paper must be presented to the folding or inserting apparatus in proper alignment, i.e., squarely, with substantially no skew between the paper edge and the entrance to the folding or inserting apparatus. See, for example, U.S. Pat. Nos. 4,169,341 of Roetter et al., and 4,077,181 of Asher et al., both assigned to the assignee of this application.

For various reasons, sheet material may be advanced skewed relative to the path of travel thereof. This may be caused by accumulated tolerances in parts, wear, etc. In automated mailing apparatus, skewed paper presented to the folding or inserting apparatus may cause jamming which would require shut down of the mailing apparatus. High speed mailing apparatus, e.g., with several thousand mail pieces per hour throughput, is particularly prone to such jamming.

The invention disclosed herein addresses alignment of folded or unfolded sheet material as it is advanced towards the folding or insertion apparatus.

SUMMARY OF THE INVENTION

It is an object of the invention disclosed herein to improve the alignment of sheet material relative to a path along which the sheet material is being advanced.

It is another object of the invention to improve apparatus advancing sheet material to facilitate adjustment thereto with respect to alignment of the sheet material relative to its path of advance.

It is another object of the invention to facilitate adjustment of the relative positioning of pushers which engage and advance sheet material in sheet material advancing apparatus.

It is another object of the invention to adjust the alignment of sheet material being advanced by a sheet material advancing apparatus while the sheet material is being advanced.

It is another object of the invention to provide a modular sheet material advancing apparatus, for example, a paper advancing and/or inserting apparatus for a mailing apparatus, in which the alignment of the sheet material may easily be adjusted.

The above and other objects of the invention are achieved by adjusting, in a sheet material advancing apparatus comprising two endless belts (or chains or the equivalent) and means carried by each belt for engaging sheet material on the belt, the angular position of the wheel or pulley that rotates one of the belts relative to the wheel or pulley that rotates the other belt.

In accordance with the invention, adjustment of the angular position of the adjusted wheel or pulley may be accomplished while the belts are being rotated, i.e., while the sheet material is being advanced, or while the belts are stationary. The invention may be used in high speed mailing apparatus which processes up to several thousand mail pieces per hour. For operation in such systems, the sheet material may be advanced at speeds of up to 50 inches per second.

In a specific embodiment, apparatus for advancing sheet material along a given path comprises first and second endless belts and means for driving and supporting the belts in respective parallel runs which together for at least a portion thereof define the given path. An outer surface of each belt lies in a common plane defining a support for the sheet material. Means are coupled to the belts for engaging an upstream edge of sheet material disposed on the belts. The engaging means is generally aligned so as to define an engaging line generally perpendicular to the runs, and the engaging means engages the sheet material along the engaging line to advance the sheet material along the given path when the belts are driven. Means are provided in this embodiment for adjusting the relative positioning of the engaging means to thereby adjust the engaging line relative to the runs.

In a preferred embodiment, the drive means comprises a first shaft and first and second pulleys mounted thereto, and a second shaft and third and fourth pulleys mounted thereto. The first belt passes around the first and third pulleys and the second belt passes around the second and fourth pulleys. The first pulley is fixed to the first shaft to rotate therewith and drive the first belt, and the second pulley is rotatably mounted to the first shaft. The drive means rotates the first shaft. Means couple the drive means to the second pulley to drive the second pulley in synchronism with the first pulley and thereby drive the second belt in synchronism with the first belt. The adjusting means adjusts the second pulley to adjust the engaging means coupled to the second belt relative to the engaging means coupled to the first belt. In the preferred embodiment, the engaging means comprises a first projection or pusher fixed to the first belt and having a downstream surface extending generally normally from the outer surface of the first belt, and a second projection or pusher fixed to the second belt having a downstream surface and extending generally normally from the outer surface of the second belt.

In the preferred embodiment, the adjusting means comprises means coupled to the second pulley for rotating the second pulley relative to the first shaft and the first pulley independently of rotation of the first shaft and the first pulley. Preferably, the adjusting means is operative to rotate the second pulley independently of whether the driving means is driving the first and second pulleys.

In the preferred embodiment, a first helical gear is fixed to the second pulley to rotate therewith. A second helical gear is meshed with and drives the first helical gear. Means couple the driving means to the second helical gear to rotate the second helical gear in synchronism with rotation of the first shaft. The adjusting means is coupled to the second helical gear to move the second helical gear axially relative to the first helical gear. Such axial movement of the second helical gear causes the teeth of the second helical gear to cam against the teeth of the first helical gear and thereby rotate the first helical gear and the second pulley relative to the first shaft.

In the preferred embodiment, the means coupling the second helical gear to the driving means comprises a third shaft to which the second helical gear is fixed, a third gear connected to the first pulley to rotate therewith, a fourth gear connected to the third shaft meshing with and being driven by the third gear, means for supporting the third shaft for rotation and for limited axial movement, and means coupled to the third shaft for axially moving the third shaft.

The moving means comprises a blind hole non-rotatably coupled to one end of the third shaft, e.g., by a thrust bearing, and an axially adjustable rod having a free end received in the blind hole. The means for supporting the third shaft permits the third shaft to move axially upon axial adjustment of the rod. The rod may be threaded to a frame of the apparatus to be axially adjustable relative to the third shaft.

The third and fourth gears are preferably helical gears. The senses of the first and second helical gears are opposite to those of the third and fourth helical gears. As a result, axial movement of the third shaft will cause the fourth helical gear to rotate in a direction opposite that for the second helical gear. This causes the pushers to be adjusted in opposite directions.

In accordance with the invention, the advancing apparatus, the engaging means and the means for adjusting the engaging means may form a self-contained module including a prime driver, e.g. an electric motor, or means for receiving a prime drive, e.g., gearing or belts coupled to an external electrical motor.

BRIEF DESCRIPTION OF THE DRAWINGS

The invention is illustrated in the accompanying drawings by way of example and not limitation, in which like references denote like or corresponding parts, and in which.

DESCRIPTION OF THE PREFERRED EMBODIMENTS

Figure 1:
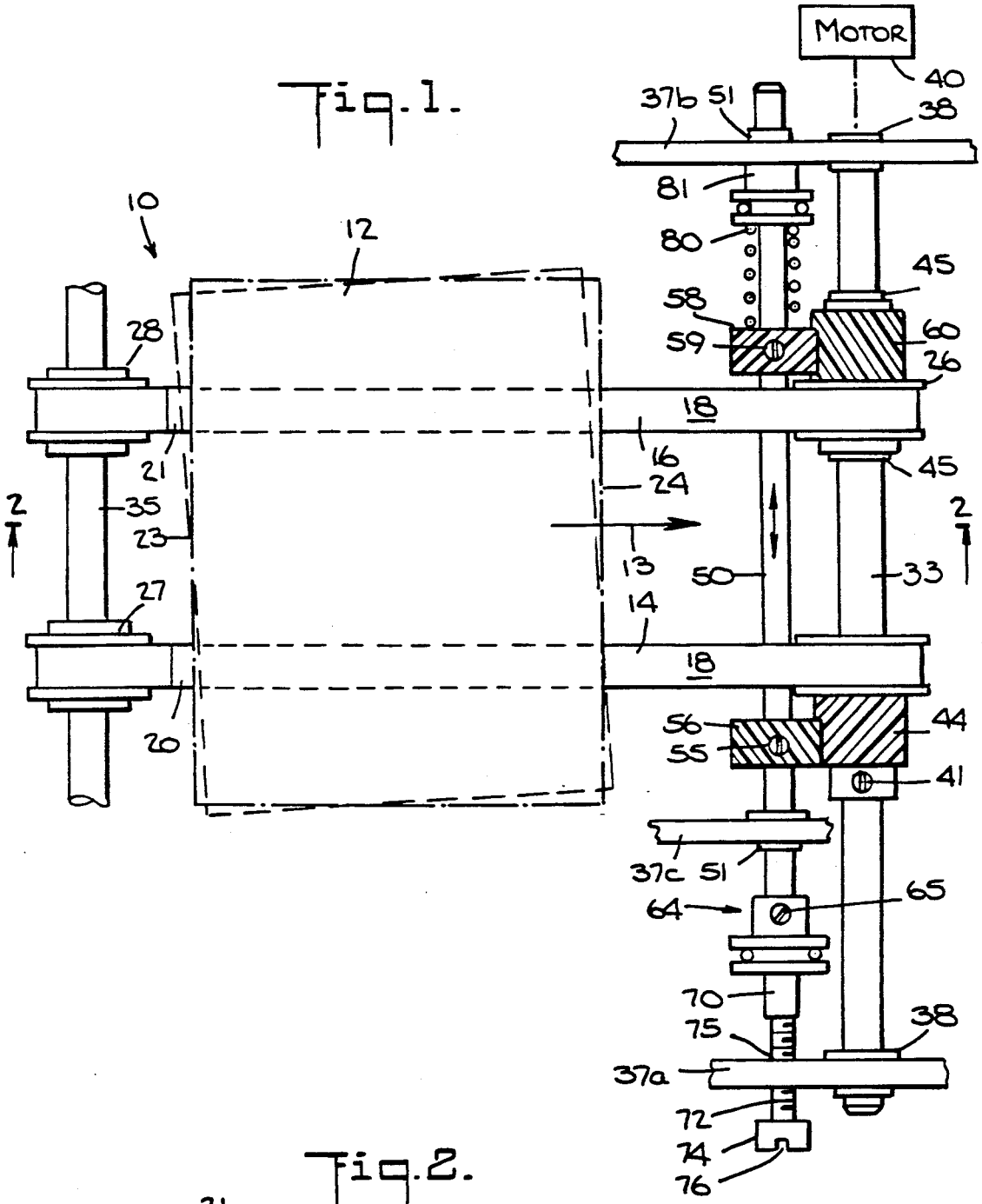
FIG. 1 is a plan view of apparatus incorporating the invention advancing a sheet of paper from left to right.

Referring to FIG. 1, advancing apparatus 10 advances a sheet (or stacked sheets) of paper 12 along a path referenced by arrow 13 from left-to-right. Apparatus 10 comprises first endless belt 14 and second endless belt 16 which are rotated clockwise in synchronism in FIG. 1. Attached to and extending normally from the outer surface 18 of endless belt 14 is a first pusher 20 and attached to and extending normally from the outer surface 18 of endless belt 16 is a second pusher 21. Pushers 20 and 21 have downstream surfaces extending normally from the respective belt outer surface 18 which engage the upstream edge 23 of paper 12 and push the paper downstream along path 13 as belts 14 and 16 are rotated clockwise. When pushers 20 and 21 are aligned with their downstream surfaces extending in an engaging line perfectly perpendicular to path 13, paper 12 is aligned with its upstream 23 and downstream 24 edges perfectly perpendicular to path 13, as illustrated by the position of paper 12 in solid lines. However, when pushers 20 and 21 are not so aligned, paper 12 is advanced skewed with respect to path 13, as illustrated by the position of paper 12 in broken lines.

Pushers 20 and 21 may be misaligned upon assembly of apparatus 10, during manufacture, as a result of accumulated tolerances in the pulleys, the belts and the shaft mountings, or by uneven wearing of the belts and/or pulleys.

Figure 2:
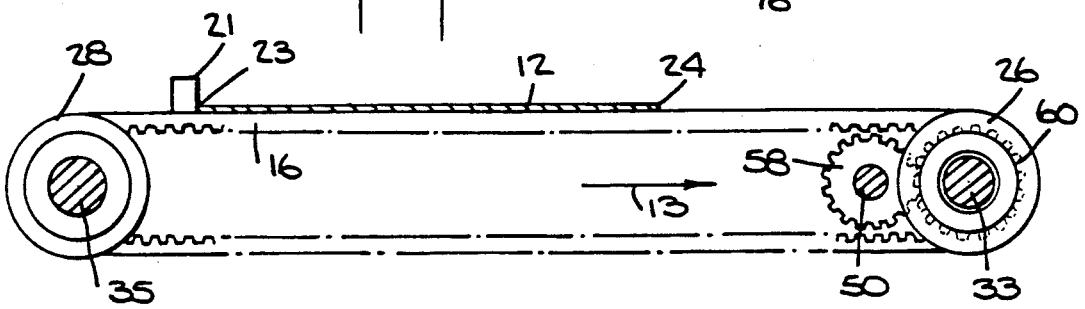
FIG. 2 is a section view of the apparatus depicted in FIG. 1 taken along line 2—2 thereof.

First and second belts 14 and 16 are passed around first and second (downstream) pulleys 25 and 26, respectively, and third and fourth (upstream) pulleys 27 and 28, respectively. First and second pulleys 25 and 26 are mounted to first shaft 33 and third and fourth pulleys 27 and 28 are mounted to second shaft 35. Shaft 33 is rotatably supported in a frame 37*a*, 37*b* on both sides by bearings 38 (FIG. 1), and shaft 35 is mounted to frame 37*a*, 37*b* by bearings (not shown). The respective pulleys are mounted to the respective shafts to support and drive belts 14 and 16 with the outer surfaces 18 of the belts in a common plane in respective runs which together define path 13. In FIG. 2, the plane of the outer surfaces 18 of belts 14 and 16 and path 13 is shown as horizontal, but it may be inclined. In this embodiment, an electric motor 40 drives first shaft 33, and first and second downstream pulleys 25 and 26 are driven and function as the driving pulleys for belts 14 and 16 respectively. Motor 40 may be a variable speed motor which drives shaft 33 up to about 1000 RPM. Endless belts 14 and 16 include teeth on the inner surface thereof which are engaged by corresponding teeth (not shown) on at least the driving pulleys 25 and 26.

First pulley 25 is fixed to first shaft 33 by a screw 41 (FIG. 1) and second pulley 26 is rotatably mounted to first shaft 33 and axially held in position on first shaft 33 by spring clips 45 retained in respective circumferential grooves 46 (FIG. 3) in first shaft 33. Fixed to first pulley 25 to rotate therewith is a first helical gear 44. A third shaft 50 is rotatably supported adjacent and parallel to first shaft 33 in frame 37*b*, 37*c* by bearings 51. Third shaft 50 has fixed thereto by a screw 55 a second helical gear 56 which meshes with and is driven by first helical gear 44. A third helical gear 58 is fixed by a screw 59 to third shaft 50 to rotate therewith and a fourth helical gear 60 meshing with third helical gear 58 is attached to second pulley 26 to rotate therewith. First helical gear 44 and fourth helical gear 60 are mounted on first shaft 33 in opposite senses, i.e., with the helixes extending in opposite directions. Similarly, second helical gear 56 and third helical gear 58 are mounted on third shaft 50 in opposite senses.

In operation, shaft 33 is driven by motor 40 to rotate first pulley 25 and first helical gear 44 connected thereto in a clockwise direction. First helical gear 44 rotates second helical gear 56 and with it third shaft 50 in a counterclockwise direction. Third shaft 50 rotating counterclockwise rotates third helical gear 58 counterclockwise which rotates fourth helical gear 60 and second pulley 26 clockwise. Clockwise rotation of first and second pulleys 25, 26 rotates first and second belts 14 and 16 clockwise. Since pulleys 25 and 26 are driven in synchronism, pushers 20 and 21 move clockwise in synchronism left-to-right in the figures. In the illustrated embodiment, belts 14 and 16 are moved at a linear speed of up to about 50 inches per second.

Third shaft 50 is supported by frame 37*b*, 37*c* for limited axial movement, as described below. Axial movement of shaft 33 axially moves third helical gear 58 relative to fourth helical gear 60. Such movement of helical gear 58 relative to helical gear 60 causes the teeth of helical gear 58 to cam against the teeth of helical gear 60 rotate helical gear 60 relative to first shaft 33 and first pulley 25. This causes second belt 16 to rotate slightly while first belt 14 remains stationary, which moves second pusher 21 relative to first pusher 20 along path 13. At the same time, axial movement of helical gear 56 relative to helical gear 44 similarly rotates helical gear 44, but in the opposite direction from the adjusting rotation of helical gear 60. This causes belts 14 and 16 to move in opposite directions to adjust pushers 20 and 21 in opposite directions, which pivots the engaging line formed by the upstream surfaces of pushers 20 and 21 to thereby adjust the skew of the upstream 23 and downstream 24 edges of paper 12 relative to path 13.

Limited axial movement of third shaft 50 is obtained as follows. A thrust bearing 64 coupled to shaft 50 by a screw 65 has a blind hold 70 on its non-rotating side which slidably receives one end of rod 72 therein. The other end of rod 72 has an actuating control in the form of an enlarged knurled knob 74 fixed thereto. Rod 72 has external threads between knob 74 and the end of rod 72 in blind hole 70. Frame 37*a* has a threaded hole 75 therein through which the threaded portion of rod 72 is screwed. Knob 74 protrudes through frame 37*a* so that it may be manually turned either by manually grasping the knob or by inserting a suitable implement such as a screw driver into a slot 76 in the face of knob 74. Thus, rotating or screwing rod 72 moves it axially through frame 37*a*. A flexible shaft (not shown) may be connected to knob 74 or rod 72 may be rotated remotely, if desired. Shaft 50 is urged against rod 72 by a coil spring 80 mounted on shaft 50 engaged between third helical gear 58 and another thrust bearing 81 mounted to shaft 50. Thrust bearing 81 allows spring 80 to rotate with shaft 50. Since gear 58 is fixed to shaft 50, spring 80 bearing against gear 58 urges shaft 50 axially towards rod 72 to spring load shaft 50 against the end of rod 72 so that the end of rod 72 is axially engaged in blind hole 70, i.e., there is no axial free space in the blind hold 70. Counterclockwise rotation of rod 72 causes shaft 50 to be drawn towards frame 37*a* and clockwise rotation of rod 72 causes shaft 50 to be moved towards frame 37*b* against the force of coil spring 80.

Figure 3:
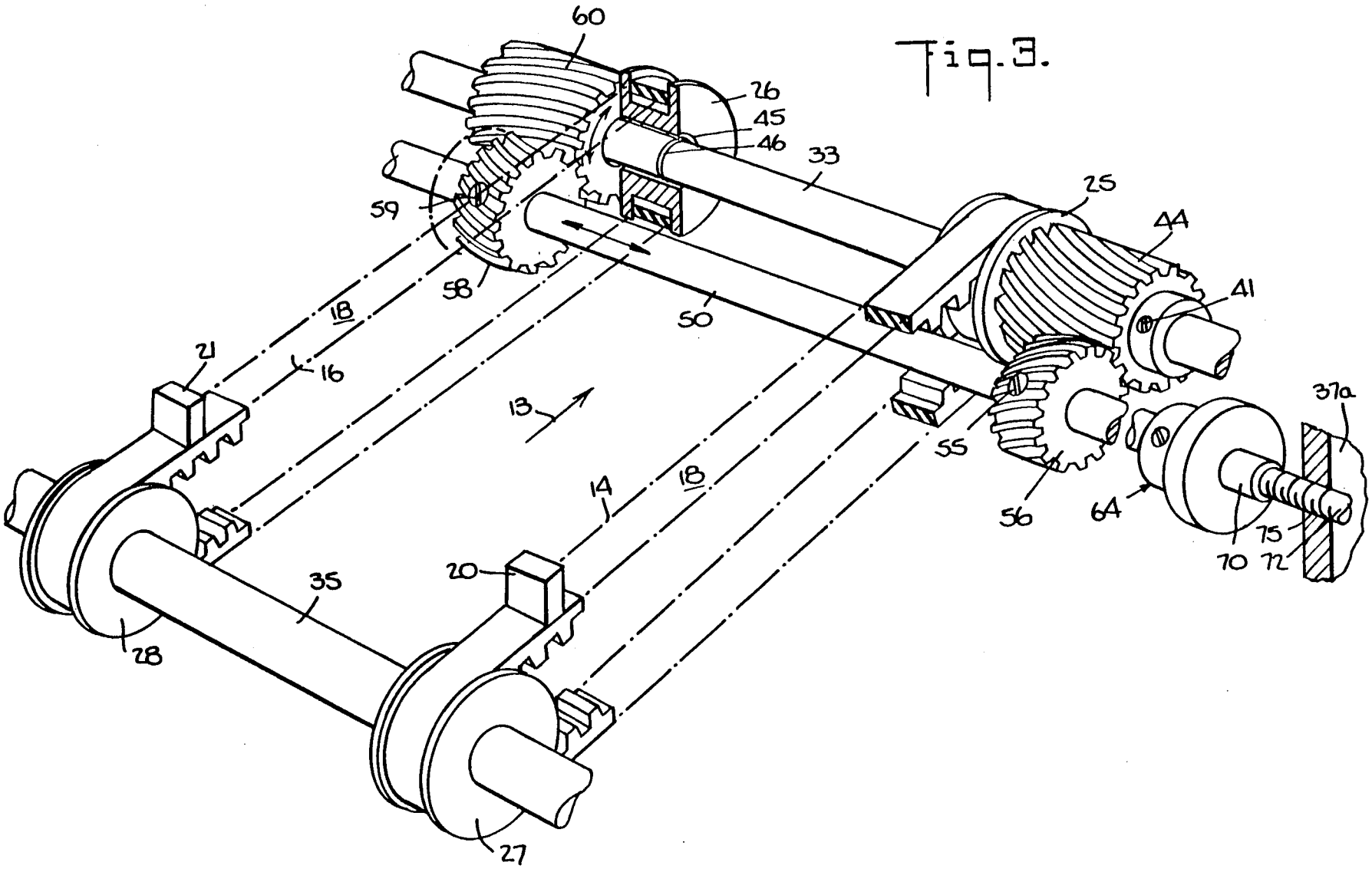
FIG. 3 is a perspective view partially in section an partially broken away of a portion of the apparatus depicted in FIG. 1.

FIGS. 1 and 3 depict shaft 50 at one end of its axial travel with rod 72 in its most counterclockwise position. Clockwise rotation of rod 72 axially moves second helical gear 50 and third helical gear 58 towards frame 37*b*. As shaft 50 is axially moved towards frame 37*b*, third helical gear 58 rotates fourth helical gear 60, second pulley 26 and second belt 16 clockwise while second helical gear 56 rotates first helical gear 44, first pulley 25, first shaft 33 and first belt 14 counterclockwise, as described above. This action moves pushers 20 and 21 in opposite directions so that the engaging line formed by the upstream surfaces thereof may be suitably positioned relative to the path 13.

Third shaft 50 may be axially moved by rod 72 while first shaft 33 is being driven by motor 40, i.e., belts 14 and 16 are rotating, as well as when shaft 33 is not being driven by motor 0, i.e., with belts 14 and 16 not rotating. Thus, pushers 20 and 21 may be adjusted dynamically while the apparatus 10 is operating. This permits an operator to easily de-skew paper being advanced to a folding or inserting station without shutting down the mail processing system and to quickly obtain optimal results.

The drawings illustrate unfolded paper 12 being advanced towards a folding or inserting station. The above description applies also to folded paper being advanced towards an inserting station. Similarly, the above description applies not only to advancement of a single sheet of paper as shown, but to multiple stacked or folded sheets of paper.

Apparatus 10 is self-contained and modular, and requires only that a drive be provided for shaft 33. Such drive may be provided by a self-contained motor 40, or from an external motor via gearing or belts. Being modular, apparatus 10 may be incorporated into different sheet handling apparatus and subassemblies thereof, such as mailing machines. In particular, apparatus 10 may feed paper to inserting and/or folding subassemblies of a mailing machine.

Certain changes and modifications of the embodiments of the invention herein disclosed will be readily apparent to those of skill in the art. For example, chains and sprocket wheels may be used instead of belts and pulleys, and pushers of different configuration and manner of attachment may be used. Moreover, uses of the invention other than in mailing apparatus will also be readily apparent to those of skill in the art. It is the applicant's intention to cover by the claims all such uses and all those changes and modifications which could be made to the embodiments of the invention herein chosen for the purposes of disclosure which do not depart from the spirit and scope of the invention.

What is claimed is:

1. Apparatus for advancing sheet material along a given path comprising:

first and second endless belts;

drive means for driving and supporting said belts in respective parallel runs which together for at least a portion thereof define said given path, an outer surface of each belt lying in a common plane defining a support for said sheet material;

means coupled to said belts for engaging an upstream edge of sheet material disposed on said belts, said engaging means being generally aligned so as to define an engaging line generally perpendicular to said runs, said engaging means engaging said sheet material along said line to advance said sheet material along said path when said belts are driven;

means for adjusting the relative positioning of said engaging means for adjusting said line relative to said runs; wherein said drive means comprises a first shaft and first and second pulleys mounted thereto, a second shaft and third and fourth pulleys mounted thereto, said first belt passing around said first and third pulleys, said second belt passing around said second and fourth pulleys, said drive means rotating said first shaft, said first pulley being fixed to said first shaft to rotate therewith and drive said first belt, said second pulley being rotatably mounted to said first shaft, means coupling said drive means to said second pulley to drive said second pulley in synchronism with said first pulley to drive said second belt in synchronism with said first belt, said adjusting means adjusting said second pulley to thereby adjust said engaging means coupled to said second belt relative to said engaging means coupled to said first belt.

2. The apparatus of claim 1 wherein said adjusting means comprises means coupled to said second pulley for rotating said second pulley relative to said first shaft and said first pulley independently of rotation of said first shaft and said first pulley.

3. The apparatus of claim 1 wherein said first shaft is downstream of said second shaft.

4. The apparatus of claim 1 wherein said adjusting means is operative to rotate said second pulley independently of whether said driving means is driving said first and second pulleys.

5. Apparatus for advancing sheet material along a given path comprising:

first and second endless belts;

a first shaft and first and second pulleys mounted thereto;

a second shaft and third and fourth pulleys mounted thereto;

said first belt passing around said first pulley and said third pulley, said second belt passing around said second pulley and said fourth pulley;

means for supporting said belts in respective parallel runs which together for at least a portion thereof define said given path, an outer surface of each belt lying in a common plane defining a support for said sheet material;

means for driving said first shaft;

said first pulley being fixed to said first shaft to rotate therewith and drive said first belt;

said second pulley being rotatably mounted to said first shaft;

means coupling said driving means to said second pulley to drive said second pulley in synchronism with said first pulley to drive said second belt in synchronism with said first belt;

means coupled to said belts for engaging an upstream edge of sheet material disposed on said belts, said engaging means being generally aligned so as to define an engaging line generally perpendicular to said runs, said engaging means engaging said sheet material along said line to advance said sheet material along said path when said belts are driven; and selectively actuable adjusting means coupled to said second pulley for rotating said second pulley relative to said first shaft and said first pulley independently of rotation of said first shaft and said first pulley to adjust said engaging means coupled to said second belt relative to said engaging means coupled to said first belt to adjust said line relative to said runs, said adjusting means being actuable to rotate said second pulley independently of whether said driving means is driving said first and second pulleys.

6. The apparatus of claim 5 comprising a first helical gear connected to said second pulley to rotate therewith, a second helical gear meshing with and driving said first helical gear, means coupling said driving means to said second helical gear to rotate said second helical gear in synchronism with rotation of said first shaft, and wherein said adjusting means is coupled to said second helical gear to move said second helical gear axially relative to said first helical gear to thereby rotate said first helical gear and said second pulley relative to said first shaft.

7. The apparatus of claim 6 wherein said means coupling said second helical gear to said driving means comprises a third shaft, said second helical gear being fixed to said third shaft, a third gear connected to said first pulley to rotate therewith, a fourth gear connected to said third shaft meshing with and being driven by said third gear, means for supporting said third shaft for rotation and for limited axial movement, and means coupled to said third shaft for axially moving said third shaft.

8. The apparatus of claim 7 wherein said moving means comprises a blind hole non-rotatably coupled to one end of said third shaft, an axially adjustable rod received in said blind hole, means urging said shaft towards said rod and means for axially adjusting said rod, said means for supporting said third shaft permitting said third shaft to move axially upon axial adjustment of said rod.

9. The apparatus of claim 8 wherein said third and fourth gears are helical gears having senses opposite to those of said first and second helical gears.

10. The apparatus of claim 5 wherein said engaging means comprises a first projection fixed to said first belt having a downstream surface extending generally normally from said outer surface of said first belt and a second projection fixed to said second belt having a downstream surface extending generally normally from said outer surface of said second belt.

11. The apparatus of claim 5 wherein said first shaft is downstream of said second shaft.

12. Apparatus for advancing sheet material along a given path comprising:

first and second endless belts;

a first shaft and first and second pulleys mounted thereto;

a second shaft and third and fourth pulleys mounted thereto;

said first belt passing around said first pulley and said third pulley, said second belt passing around said second pulley and said fourth pulley;

means for supporting said belts in respective parallel runs which together for at least a portion thereof define said given path, an outer surface of each belt lying in a common plane defining a support for said sheet material;

means for driving said first shaft;

said first pulley being fixed to said first shaft to rotate therewith and drive said first belt;

said second pulley being rotatably mounted to said first shaft;

a first helical gear fixed to said second pulley to rotate said second pulley upon rotation thereof;

a third shaft;

means for supporting said third shaft for rotation and for limited axial movement;

a second helical gear fixed to said third shaft to rotate therewith and meshed with said first helical gear to drive said first helical gear;

means coupling said driving means to said third shaft to rotate said third shaft in synchronism with said first shaft so as to drive said second pulley in synchronism with said first pulley and said second belt in synchronism with said first belt;

means coupled to said belts for engaging an upstream edge of sheet material disposed on said belts, said engaging means being generally aligned so as to define an engaging line generally perpendicular to said runs, said engaging means engaging said sheet material along said line to advance said sheet material along said path when said belts are driven; and selectively actuable adjusting means coupled to said third shaft for axially moving said third shaft and with it said second helical gear.

13. The apparatus of claim 12 wherein said adjusting means comprises a blind hole non-rotatably coupled to one end of said third shaft, an axially adjustable rod received in said blind hole, means urging said shaft towards said rod and means for axially adjusting said rod, said means for supporting said third shaft permitting said third shaft to move axially upon axial adjustment of said rod.

14. The apparatus of claim 12 wherein said means coupling said driving means to said third shaft comprises a third gear fixed to said first pulley to rotate therewith and a fourth gear meshed with said third gear fixed to said third shaft.

15. The apparatus of claim 14 wherein said third and fourth gears are helical gears having senses opposite to those of said first and second helical gears.

16. The apparatus of claim 12 wherein said engaging means comprises a first projection fixed to said first belt having a downstream surface extending generally normally from said outer surface of said first belt, and a second projection fixed to said second belt having a downstream surface extending generally normally from said outer surface of said second belt.

* * * * *